US007278833B2

(12) United States Patent
Higashiyama et al.

(10) Patent No.: US 7,278,833 B2
(45) Date of Patent: Oct. 9, 2007

(54) HYBRID COMPRESSOR

(75) Inventors: Akiyoshi Higashiyama, Isesaki (JP); Hideki Matsumura, Isesaki (JP); Suguru Okazawa, Isesaki (JP)

(73) Assignee: Sanden Corporation, Gunma (JP)

( * ) Notice: Subject to any disclaimer, the term of this patent is extended or adjusted under 35 U.S.C. 154(b) by 325 days.

(21) Appl. No.: 10/356,531

(22) Filed: Feb. 3, 2003

(65) Prior Publication Data

US 2003/0152467 A1 Aug. 14, 2003

(30) Foreign Application Priority Data

Feb. 8, 2002 (JP) ..... 2002-033188
Feb. 8, 2002 (JP) ..... 2002-033189
Feb. 8, 2002 (JP) ..... 2002-033190
Mar. 15, 2002 (JP) ..... 2002-071683

(51) Int. Cl.
*F04B 17/03* (2006.01)
*F04B 17/05* (2006.01)
*F01C 1/063* (2006.01)
*F04B 49/00* (2006.01)

(52) U.S. Cl. ..... 417/362; 417/374; 418/55.2

(58) Field of Classification Search ..... 417/374, 417/223, 16, 362, 316, 319; 418/54, 60, 418/55.2; 62/236, 228.4, 323.3, 323.4
See application file for complete search history.

(56) References Cited

U.S. PATENT DOCUMENTS 3,989,422 A * 11/1976 Guttinger ..... 418/55.1
4,179,248 A * 12/1979 Shaw ..... 417/427
4,277,955 A * 7/1981 Parker ..... 62/510
4,411,141 A * 10/1983 Hara ..... 62/468
4,591,318 A 5/1986 Elson ..... 417/312
4,990,071 A * 2/1991 Sugimoto ..... 418/55.2
5,173,042 A * 12/1992 Chambers ..... 418/55.1
5,178,520 A * 1/1993 Strelow ..... 417/62
5,468,130 A * 11/1995 Yamada et al. ..... 418/55.2
5,755,564 A 5/1998 Machida et al. ..... 418/55.2
5,867,996 A 2/1999 Takano et al. ..... 62/175
6,056,516 A * 5/2000 Schonfeld et al. ..... 417/286
6,132,191 A * 10/2000 Hugenroth et al. ..... 418/55.1
6,192,155 B1 2/2001 Fan ..... 382/225

(Continued)

FOREIGN PATENT DOCUMENTS

DE 19513710 10/1995

(Continued)

OTHER PUBLICATIONS

Random House College Dictionary, Revised Edition; Random House Inc, NY, 1984. pp. 271 and 130.*

*Primary Examiner*—Charles G Freay
(74) *Attorney, Agent, or Firm*—Baker Botts LLP

(57) ABSTRACT

A hybrid compressor includes a first compression mechanism, which is driven by a first drive source, a second compression mechanism, which is driven by a second drive source, and a communication path communicating between a suction chamber of the first compression mechanism and a suction chamber of the second compression mechanism. The first compression mechanism may be adapted only to be driven by the first drive source and the second compression mechanism may be adapted only to be driven the second drive source. Therefore, the compression mechanisms are adapted to their respective drive sources.

18 Claims, 7 Drawing Sheets

U.S. PATENT DOCUMENTS

| | | | | |
|---|---|---|---|---|
| 6,217,297 | B1 | 4/2001 | Tsumagari et al. | 417/360 |
| 6,230,507 | B1 | 5/2001 | Ban et al. | 62/228.48 |
| 6,234,769 | B1 * | 5/2001 | Sakai et al. | 417/374 |
| 6,247,899 | B1 | 6/2001 | Ban et al. | 417/16 |
| 6,287,081 | B1 | 9/2001 | Tamegai et al. | 417/15 |
| 6,334,755 | B1 | 1/2002 | Coudray et al. | 415/115 |
| 6,375,436 | B1 | 4/2002 | Irie et al. | 417/223 |
| 6,443,712 | B2 | 9/2002 | Sakai et al. | 417/374 |
| 6,543,243 | B2 * | 4/2003 | Mohrmann et al. | 62/230 |
| 7,021,902 | B2 * | 4/2006 | Terauchi | 417/223 |
| 2001/0047659 | A1 | 12/2001 | Nakamura et al. | |
| 2001/0049943 | A1 | 12/2001 | Nakamura et al. | |
| 2002/0194858 | A1 * | 12/2002 | Mohrmann et al. | 62/236 |
| 2003/0053916 | A1 | 3/2003 | Terauchi | |
| 2003/0136138 | A1 | 7/2003 | Tsuboli et al. | |
| 2004/0000156 | A1 | 1/2004 | Inoue et al. | |
| 2004/0001760 | A1 | 1/2004 | Yoshii et al. | |
| 2004/0020229 | A1 | 2/2004 | Adachi et al. | |

FOREIGN PATENT DOCUMENTS

| | | |
|---|---|---|
| EP | 1213166 | 6/2002 |
| JP | 529153 | 6/1993 |
| JP | 687678 | 12/1994 |

* cited by examiner

HYBRID COMPRESSOR

BACKGROUND OF THE INVENTION

1. Field of the Invention

The present invention relates to a hybrid compressor having two compression mechanisms driven by drive sources different from each other.

2. Description of Related Art

A hybrid compressor capable of being driven by an internal combustion engine of a vehicle or an electric motor, or both, is described in Japanese Utility Model (Laid-Open) No. 6-87678 and JP-A-2000-130323. Such hybrid compressors include a clutch for the engagement of a single compression mechanism to an internal combustion engine of a vehicle or an electric motor incorporated into the compressor, or both, and for the disengagement of such a single compression mechanism from such an engine or motor or both.

Nevertheless, in hybrid compressors, such as those described in Japanese Utility Model (Laid-Open) No. 6-87678 and JP-A-2000-130323, it is difficult to adapt the single compression mechanism to two drive sources, such as an engine and an electric motor, which differ from each other in output characteristics. In particular, because the engine and the electric motor, which differ from each other in output characteristics, are switched selectively as the drive source, it is difficult or impossible to operate each drive source at a maximum or optimal efficiency. Further, a pulsation in the output of such compressors also may occur when the drive sources are switched. In order to suppress such pulsation, it may be necessary to increase the capacity of the discharge chamber and of the suction chamber. However, because a discharge chamber and a suction chamber are formed within a compressor housing, if the capacities of the discharge chamber and the suction chamber are increased, the length of the housing and the size of the compressor also increase.

SUMMARY OF THE INVENTION

Accordingly, it is an object of the present invention to provide an improved hybrid compressor which avoids the disadvantages of known compressors, as described above.

To achieve the foregoing and other objects, a hybrid compressor according to an embodiment of the present invention is provided. The hybrid compressor comprises a first compression mechanism, which is driven by a first drive source, and a second compression mechanism, which is driven by a second drive source. The first and second compression mechanisms are integrally formed in the compressor. The hybrid compressor further comprises a communication path placing a first suction chamber of the first compression mechanism in communication with a second suction chamber of the second compression mechanism. The first compression mechanism may be driven exclusively by the first drive source, and the second compression mechanism may be driven exclusively by the second drive source.

Because the first compression mechanism may be driven exclusively by the first drive source and the second compression mechanism may be driven exclusively by the second drive source, the first compression mechanism is adapted only to be driven by the first drive source and the second compression mechanism is adapted only to be driven by the second drive source. Therefore, in such hybrid compressors, there is no problem of adaptability between the compression mechanisms and the drive sources.

Further, because the first and second suction chambers of the first and second compression mechanisms communicate with each other via the communication path, when one compression mechanism is in operation and the other compression mechanism is not in operation, even if oil or refrigerant, or both, flows from an external refrigerant circuit into the non-operating compression mechanism, the oil or refrigerant, or both, is drawn into the operating compression mechanism via the communication path. Thus, oil or refrigerant, or both, does not remain in the non-operating compression mechanism, but flows in both directions between the operating and the non-operating compressors. Therefore, the operating compression mechanism does not lack lubricant, and when the non-operating compression mechanism starts operation, that compression mechanism is supplied with liquid refrigerant.

In another embodiment of the above-described hybrid compressor according to the present invention, the communication path communicates between a lower portion of the suction chamber of the operating compression mechanisms and a lower portion of the suction chamber of the other compression mechanism. In such a compressor, even if oil or refrigerant, or both, flowing into or received within the suction chamber of the non-operating compression mechanism is stored in the lower portion of the suction chamber, the oil or refrigerant, or both, is drawn into the lower portion of the suction chamber of the operating compression mechanism via the communication path. The oil or refrigerant, or both, is discharged from the suction chamber of the non-operating compression mechanism.

In still another embodiment, the hybrid compressor according to the present invention comprises a first compression mechanism, which is driven by a first drive source; and a second compression mechanism, which is driven by a second drive source. The second compression mechanism is incorporated into the compressor integrally with the first compression mechanism. The compressor further comprises a suction chamber common to both the first and second compression mechanisms.

In addition, in this hybrid compressor, because the first compression mechanism may be driven exclusively by the first drive source and the second compression mechanism may be driven exclusively by the second drive source, the first compression mechanism is adapted only to be driven by the first drive source and the second compression mechanism is adapted only to be driven by the second drive source. Therefore, in this hybrid compressor, the compression mechanisms are adaptable to their respective drive sources.

Further, because the first and second compression mechanisms have a common suction chamber, when oil or refrigerant, or both, flows from an external refrigerant circuit into the suction chamber, it is drawn into the operating compression mechanism and does not remain in the suction chamber. Therefore, the operating compression mechanism does not lack lubricant, and when the non-operating compression mechanism starts to operate, that compression mechanism immediately compresses liquid refrigerant.

In yet another embodiment of the above-described hybrid compressor, the hybrid compressor has a single inlet port. Refrigerant flowing into one compression mechanism through the single inlet port also may flow into the other compression mechanism through the communication path. Alternatively, refrigerant introduced through the single inlet port may flow into the common suction chamber. By this configuration of the single inlet port, the structure of the hybrid compressor may be simplified, and the cost for manufacturing the compressor may be reduced.

In still yet another embodiment of the above-described hybrid compressor, the first and second compression mechanisms are scroll-type compression mechanisms. In this structure, for example, by disposing a first fixed scroll of the first compression mechanism and a second fixed scroll of the second compression mechanism opposingly, e.g., back-to-back, and by providing a common discharge path between the first and second compression mechanisms, the size of the hybrid compressor may be reduced.

In a further embodiment of the above-described hybrid compressor, the first drive source is an internal combustion engine or a first electric motor for running a vehicle, and the second drive source is a second electric motor. Specifically, when the hybrid compressor is mounted on a vehicle, an internal combustion engine or a first electric motor for running the vehicle is used as the first drive source for the hybrid compressor, and a second electric motor incorporated into the hybrid compressor or provided only for driving the hybrid compressor is used as the second drive source.

Further, the present invention provides a hybrid compressor comprising a scroll-type first compression mechanism, which is driven by a first drive source; a scroll-type second compression mechanism, which is driven by a second drive source, and which is incorporated into the compressor integrally with the first compression mechanism; and a housing containing the first and second compression mechanisms. A first fixed scroll of the first compression mechanism and a second fixed scroll of the second compression mechanism are disposed opposingly, e.g., back-to-back, and the two fixed scrolls and a shared portion of said housing are formed integrally.

Moreover, in this hybrid compressor, because the first compression mechanism may be driven exclusively by the first drive source and the second compression mechanism may be driven exclusively by the second drive source, the first compression mechanism is adapted only to be driven by the first drive source and the second compression mechanism is adapted only to be driven by the second drive source. Therefore, in this hybrid compressor, the compression mechanisms are adaptable to their respective drive sources.

In addition, because the first fixed scroll of the first compression mechanism and the second fixed scroll of the second compression mechanism are disposed opposingly, e.g., back-to-back, a common discharge path may be formed between the fixed scrolls. By this configuration, the size of the hybrid compressor may be reduced. Moreover, because the two fixed scrolls and a shared portion of the housing are formed integrally, the number of parts for the compressor may be decreased, and the cost for manufacturing the hybrid compressor may be reduced, when compared with the embodiment in which these three parts are formed separatedly.

In a still further embodiment of this hybrid compressor, the first drive source is an internal combustion engine or a first electric motor for running a vehicle, and the second drive source is a second electric motor e.g., a second electric motor dedicated to driving the compressor.

In another preferred embodiment of this hybrid compressor, at least a pair of opposing surfaces of the integrally formed first and second fixed scrolls are treated to harden the pair of surfaces. Because an integrally formed plate member shared by the first and second fixed scroll is surface treated as a single unit, the surface treatment may be performed by a single process. Therefore, the number of the processes required for surface treatment of the fixed scrolls may be reduced, the cost for the surface treatment may be reduced, and the productivity of the hybrid compressor may be improved. For example, anodizing and electroless nickel plating may be employed as the surface treatment for hardening. Such surface treatments may increase the hardness of the surfaces of fixed spiral elements of the integral fixed scrolls, thereby increasing the durability of the surfaces.

In yet a further embodiment, a hybrid compressor comprises a first compression mechanism, which is driven by a first drive source; a second compression mechanism, which is driven by a second drive source, and which is incorporated integrally into the compressor with the first compression mechanism; and a housing containing the first and second compression mechanisms. At least one of a discharge chamber and a suction chamber for the first and second compression mechanisms is formed radially on or about the exterior of the housing.

In this hybrid compressor, because the discharge chamber or the suction chamber, or both, is formed radially on or about the exterior of the housing, the capacity of the chamber or the chambers may be increased while increases in the length of the housing may be limited or eliminated. Especially in hybrid compressors, because a plurality of drive sources generally are disposed in series in the longitudinal direction of the housing, the length of the housing tends to increase. However, in this hybrid compressor, such increases in the length of the housing may be limited or eliminated, while ensuring a sufficient capacity for a discharge chamber or a suction chamber, or both. By enlarging the capacity of the discharge chamber, pulsation in discharge may be limited or eliminated, and by increasing the capacity of the suction chamber, pulsation during suction may be limited or eliminated. Moreover, because the chamber or the chambers are disposed outside of the housing, the disposition of the chamber or the chambers may be varied, and ultimately, the design of the compressor may become more varied.

In still yet a further embodiment of this hybrid compressor, at least one of the discharge chamber and the suction chamber is formed by an annular wall projecting from an exterior surface of the housing and a lid abutting the annular wall and creating one or more cavities between the lid and the exterior of the housing. In this structure, the discharge chamber or the suction chamber, or both, may be readily formed outside the housing.

In an additional embodiment of this hybrid compressor, the first and second compression mechanisms are formed as scroll-type compression mechanisms. Because the length of a housing of a compressor having a scroll-type compression mechanism generally is less than that of a compressor having a piston-type compression mechanism, by forming the discharge chamber or the suction chamber, or both, on or about an exterior of the housing, the length of the housing may be decreased further.

In still an additional embodiment of this hybrid compressor, the first drive source is an internal combustion engine or a first electric motor for running a vehicle, and the second drive source is a second electric motor. Further, the present invention provides a hybrid compressor comprising a first compression mechanism, which is driven by a first drive source; a second compression mechanism, which is driven by a second drive source, and which compression mechanism is incorporated integrally into the compressor with the first compression mechanism; a housing containing the first and second compression mechanisms; and a discharge chamber for the first and second compression mechanisms provided radially on an exterior of the housing. A first discharge path is provided between the first compression mechanism and the discharge chamber, and a second discharge path is provided between the second compression mechanism and the discharge chamber.

In this hybrid compressor, because the first discharge path communicates independently with the first compression mechanism and the second discharge path communicates independently with the second compression mechanism, the fluid compressed by each compression mechanism flows into the discharge chamber exclusively through the corresponding discharge path. Therefore, any pulsation, which may occur when the compressor driven by both drive sources is switched, such that the compressor is driven by a single drive source selected from the first and second drive sources, may be effectively limited or eliminated.

In still an additional embodiment of this hybrid compressor, the first and second discharge paths communicate with a single discharge chamber. Although separate discharge chambers may be provided for each discharge path, because the capacity of the discharge chamber may be increased by forming a common discharge chamber, any pulsations during discharge may be limited or eliminated more effectively by the formation of the common discharge chamber than when separate discharge chambers are provided.

In yet an additional embodiment of this hybrid compressor, each of the discharge paths has an outlet at which it joins its discharge chamber or the common chamber, and a discharge valve is provided at each of the outlets of the first and second discharge paths for controlling the opening and closing of the first and second discharge paths. Although, when a common discharge path for the first and second compression mechanisms is provided, it may be necessary to provide a discharge valve, such as a lead valve or a ball valve, between the respective compression mechanisms and the common discharge path, it may be difficult to provide the valve in the limited space between the respective compression mechanisms. Moreover, the common discharge path generally does not work well. However, in this hybrid compressor, because a discharge valve is provided on each of the outlets of the first and second discharge paths, the ability to attach discharge valves is improved. Further, if the outlets for both the first and second discharge paths have outlets at positions near to each other, it may be possible to open and close both outlets by the use of a single discharge valve, thereby reducing the number of parts and the cost for manufacture.

In a still yet an additional embodiment of this hybrid compressor, the first and second compression mechanisms are formed as scroll-type compression mechanisms. Because a scroll-type compressor generally produces less pulsation and noise than an inclined plate-type compressor, the advantages realized in reducing pulsation may be further increased.

In a still another additional embodiment of this hybrid compressor, the first drive source is an internal combustion engine or a first electric motor for running a vehicle, and the second drive source is a second electric motor.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
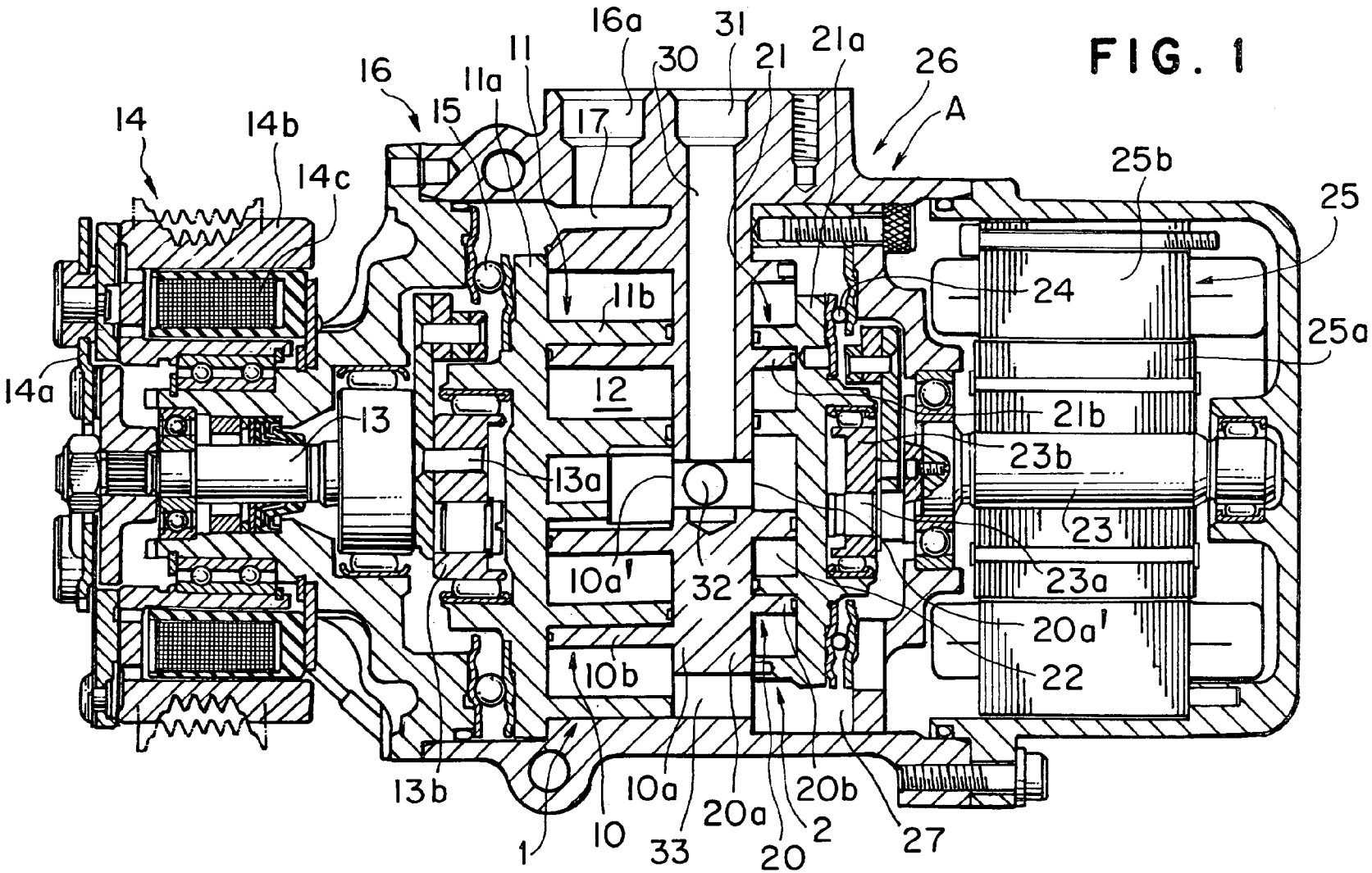
FIG. 1 is a longitudinal, cross-sectional view of a hybrid compressor according to an embodiment of the present invention.

A hybrid compressor A according to an embodiment of the present invention is depicted in FIG. 1. Referring to FIG. 1, hybrid compressor A has a first compression mechanism 1 and a second compression mechanism 2. Hybrid compressor A is used, for example, in a refrigerant cycle of an air conditioning system mounted on a vehicle.

First compression mechanism 1 comprises a first fixed scroll 10 having a first fixed end plate 10*a* and a first fixed spiral element 10*b*, an first orbital scroll 11 having a first orbital end plate 11*a*, and a first orbital spiral element 11*b*. First fixed scroll 10 and first orbital scroll 11 engage to form a plurality of pairs of first fluid pockets 12. First compression mechanism 1 also comprises a first drive shaft 13, which engages first orbital scroll 11 and provides an orbital movement to orbital scroll 11, and an electromagnetic clutch 14. The orbital movement of orbital scroll 11 is imparted via a crank pin 13*a* and an eccentric bushing 13*b*. Electromagnetic clutch 14 comprises a clutch armature 14*a* fixed to first drive shaft 13, a pulley 14*b* connected to an engine or electric motor (not shown) of a vehicle via a belt (not shown), and an electromagnet 14*c* for engaging and disengaging clutch armature 14*a* and pulley 14*b*. Further, first compression mechanism 1 comprises a first rotation prevention mechanism 15 (in the depicted embodiment, a ball coupling, but an Oldham coupling or the like may also be suitable) for preventing the rotation of first orbital scroll 11.

First fixed scroll 10, first orbital scroll 11, first drive shaft 13, and first rotation prevention device 15 are contained within a housing 16. A first inlet port 16*a* is formed through housing 16. First inlet port 16*a* communicates with a first suction chamber 17 formed around the periphery of first fixed scroll 10 and first orbital scroll 11. A first discharge port 10*a*' is formed through a first surface of first end plate 10*a* of first fixed scroll 10. The engine of a vehicle for use in driving first compression mechanism 1 may include either an internal combustion engine or an electric motor for driving a vehicle, or both.

Second compression mechanism 2 comprises a second fixed scroll 20 having a second fixed end plate 20*a* and a second fixed spiral element 20*b*, a second orbital scroll 21 having a second orbital end plate 21*a* and a second orbital spiral element 21*b*. Second fixed scroll 20 and second orbital scroll 21 engage to form a plurality of pairs of second fluid pockets 22. Second compression mechanism 2 also comprises a second drive shaft 23, which engages second orbital scroll 21 and imparts an orbital movement to second orbital scroll 21, and a second rotation prevention mechanism 24 (in this embodiment, a ball coupling, but an Oldham coupling or the like may also be suitable) for preventing the rotation of second orbital scroll 21. The orbital movement of orbital scroll 21 is imparted via a crank pin 23*a* and an eccentric bushing 23*b*. An electric motor 25 is provided for driving second drive shaft 23 of second compression mechanism 2. Electric motor 25 has a rotor 25*a* which is fixed to second drive shaft 23 and a stator 25*b*.

Second fixed scroll 20, second orbital scroll 21, second drive shaft 23, second rotation prevention device 24, and electric motor 25 are contained within a housing 26. A second suction chamber 27 is formed around the periphery of second fixed scroll 20 and second orbital scroll 21. A second discharge port 20*a*' is formed through a second surface of second end plate 20*a* of second fixed scroll 20.

First compression mechanism 1 and second compression mechanism 2 are assembled integrally. First fixed scroll 10 of first compression mechanism 1 and second fixed scroll 20 of second compression mechanism 2 are disposed back-to-back, and the fixed scrolls, a portion of first housing 16, and a portion of second housing 26 are formed integrally. Thus, together, end plates 10*a* and 20*a* form a shared end plate, and a portion of first and second housings 16 and 26 are formed integrally therewith. A common discharge path 30 is formed between end plates 10*a* and 20*a* and within the shared end plate formed by integrating end plates 10*a* and 20*a*. An outlet port 31 is formed at a downstream end of discharge path 30. First discharge port 10*a*' formed through first end plate 10*a* of first compression mechanism 1 and second discharge port 20*a*' formed through second end plate 20*a* of second compression mechanism 2 are connected to an upstream end of discharge path 30 via a check valve 32. First compression mechanism 1 and second compression mechanism 2, thus configured, are formed integrally in hybrid compressor A.

Suction chamber 17 of first compression mechanism 1 and suction chamber 27 of second compression mechanism 2 are in communication with each other via a communication path 33, which is formed through integrated end plates 10*a* and 20*a* and extends radially with respect to the integrated end plates 10*a* and 20*a*. Communication path 33 communicates between a lower portion of first suction chamber 17 of first compression mechanism 1 and a lower portion of second suction chamber 27 of second compression mechanism 2, when one of the compression mechanisms is in operation, and when both compression mechanisms are in operation.

When hybrid compressor A is driven by an engine, electromagnetic clutch 14 is engaged, the rotational output of the engine is transmitted to first drive shaft 13 of first compression mechanism 1 via clutch armature 14*a*, and first orbital scroll 11 is driven in an orbital movement by first drive shaft 13. Refrigerant introduced from inlet port 16 flows into fluid pockets 12 through first suction chamber 17 of first compression mechanism 1. Fluid pockets 12 move toward the center of first fixed scroll 10 while being reduced in volume, whereby the refrigerant in fluid pockets 12 is compressed. The compressed refrigerant is discharged to discharge path 30 through first discharge port 10*a*' formed through the first end surface of first end plate 10*a* of fixed scroll 10 via check valve 32. The discharged refrigerant then flows out to a high pressure side of an external refrigerant circuit through outlet port 31.

In this operation, electric power need not be, and generally is not, supplied to electric motor 25 in order to drive second compression mechanism 2, and, consequently, electric motor 25 does not rotate. Therefore, second compression mechanism 2 does not operate. Because second discharge port 20*a*' of second compression mechanism 2 is closed by check valve 32, the refrigerant discharged from first compression mechanism 1 does not flow backwards into second compression mechanism 2.

When hybrid compressor A is driven by electric motor 25, electric motor 25 is activated, the rotational output of the electric motor 25 is transmitted to second drive shaft 23 of second compression mechanism 2, and second orbital scroll 21 is driven in an orbital movement by second drive shaft 23. Refrigerant introduced from inlet port 16 passes through first suction chamber 17 of first compression mechanism 1, communication path 33, and second suction chamber 27 of second compression mechanism 2 and then flows into fluid pockets 22. Fluid pockets 22 move toward the center of second fixed scroll 20 while being reduced in volume, whereby the refrigerant in fluid pockets 22 is compressed. The compressed refrigerant is discharged to discharge path 30 through second discharge port 20*a*' formed through the second end surface of second end plate 20*a* of second fixed scroll 20 via check valve 32. The discharged refrigerant then flows out to the high pressure side of an external refrigerant circuit through outlet port 31.

In this configuration, electric power is not supplied to electromagnetic clutch 14 of first compression mechanism 1, and the rotational output of the engine of a vehicle is not transmitted to first compression mechanism 1. Therefore, first compression mechanism 1 does not operate. Because first discharge port 10*a*' of first compression mechanism 1 is closed by check valve 32, the refrigerant discharged from second compression mechanism 2 does not flow backwards into first compression mechanism 1.

In hybrid compressor A, because first compression mechanism 1 is driven exclusively by an engine of a vehicle, which is a first drive source, and because second compression mechanism 2 is driven exclusively by electric motor 25, which is a second drive source different from the first drive source, the first compression mechanism 1 is adapted only to be driven by an engine of a vehicle having a relatively large output, and the second compression mechanism 2 is adapted only to be driven by electric motor 25 having a relatively small output. Therefore, in hybrid compressor A, the compression mechanisms are adapted to their respective drive sources without difficulty.

Further, the size of hybrid compressor A may be reduced by integrally forming first compression mechanism 1 and second compression mechanism 2, in particular, by disposing first and second fixed scrolls 10 and 20 back-to-back. Moreover, the size of hybrid compressor A may be reduced further by providing a single discharge path 30 for common use by first compression mechanism 1 and second compression mechanism 2. Especially, in this embodiment, because first fixed scroll 10, second fixed scroll 20 and a shared portion of housings 16 and 26 are integrally formed, the number of parts may decrease, and the cost for manufacturing hybrid compressor A may be reduced. Further, in such an integral structure, surface treatment for hardening the surfaces of first and second fixed scrolls 10 and 20 may be simplified and facilitated, because the integrated scrolls may be treated as a single unit for the surface treatment.

Further, in this embodiment, because first suction chamber 17 of first compression mechanism 1 and second suction chamber 27 of second compression mechanism 2 communicate via communication path 33, when second compression mechanism 2 is in operation and first compression mechanism 1 is not in operation, refrigerant or oil, or both, which is introduced from an external refrigerant circuit into first suction chamber 17 of first compression mechanism 1, is drawn into second suction chamber of second compression mechanism 2 through communication path 33. Such refrigerant or oil, or both, does not remain in the first suction chamber 17 of first compression mechanism 1 when compression mechanism 1 is not in operation. Therefore, second compression mechanism 2 will not lack lubrication when in operation, and first compression mechanism 1 will not compress liquid refrigerant when it first starts to operate.

Refrigerant introduced from single inlet port 16*a* into first suction chamber 17 of first compression mechanism 1 may flow into second suction chamber 27 of second compression mechanism 2 through communication path 33. Therefore, even if the suction port is a single inlet port, the two compression mechanisms 1 and 2 may operate without difficulty. By the structure of single inlet port 16*a*, the structure of hybrid compressor A may be simplified, and the cost for manufacture thereof may be reduced.

Further, in this embodiment, because communication path 33 extends between a first lower portion of first suction chamber 17 of first compression mechanism 1 and a second lower portion of second suction chamber 27 of second compression mechanism 2, even if refrigerant or oil, or both, introduced into first suction chamber 17 of first compression mechanism 1 when it is not in operation is stored in the first lower portion of the first suction chamber 17, such refrigerant or oil, or both, may be drawn into the second lower portion of second suction chamber 27 of second compression mechanism 2 without difficulty, and the stored refrigerant or oil, or both, may be discharged from the first suction chamber 17.

When the vehicle has both an internal combustion engine and an electric motor for driving a vehicle, first compression mechanism 1 may be driven by either of these drive sources, which may be selectively switched. Further, second compression mechanism 2 may be driven by another electric motor separatedly provided, instead of electric motor 25. Moreover, another electric motor, other than the internal combustion engine and the electric motor for driving a vehicle, may be provided as the first drive source for first compression mechanism 1, and the first compression mechanism 1 may be driven by one or more drive sources selected from these drive sources.

Another inlet port, similar to inlet port 16*a*, may be provided through housing 26 of second compression mechanism 2, in addition to inlet port 16*a*. For example, when first compression mechanism 1 is in operation and second compression mechanism 2 is not in operation, a portion of refrigerant and oil circulated from an external refrigerant circuit into hybrid compressor A flows into second suction chamber 27 of second compression mechanism 2 through a divergent portion of a circulation path. However, because the introduced refrigerant and oil are drawn into first suction chamber 17 of first compression mechanism 1 through communication path 33 during operation, the refrigerant and oil do not remain in the first suction chamber 17 of first compression mechanism 1. Therefore, first compression mechanism 1 does not lack lubrication during operation, and second compression mechanism 2 does not compress liquid refrigerant when it starts to operate.

Further, first compression mechanism 1 or second compression mechanism 2, or both, may be a compression mechanism other than a scroll-type compression mechanism, such as an inclined plate-type or a vane-type compression mechanism. When first compression mechanism 1 and second compression mechanism 2 are formed as inclined plate-type or vane-type compression mechanisms, first and second compression mechanisms 1 and 2 may have a common suction chamber. In such a configuration having a common suction chamber, when refrigerant and oil are circulated from an external refrigerant circuit into the common suction chamber, the introduced refrigerant and oil may be drawn into operating compression mechanism 1 or 2, or both, and the refrigerant and oil do not remain in the common suction chamber. Therefore, an operating compression mechanism will not lack lubrication, and the non-operating compression mechanism will not compress liquid refrigerant when it starts to operate.

Figure 2:
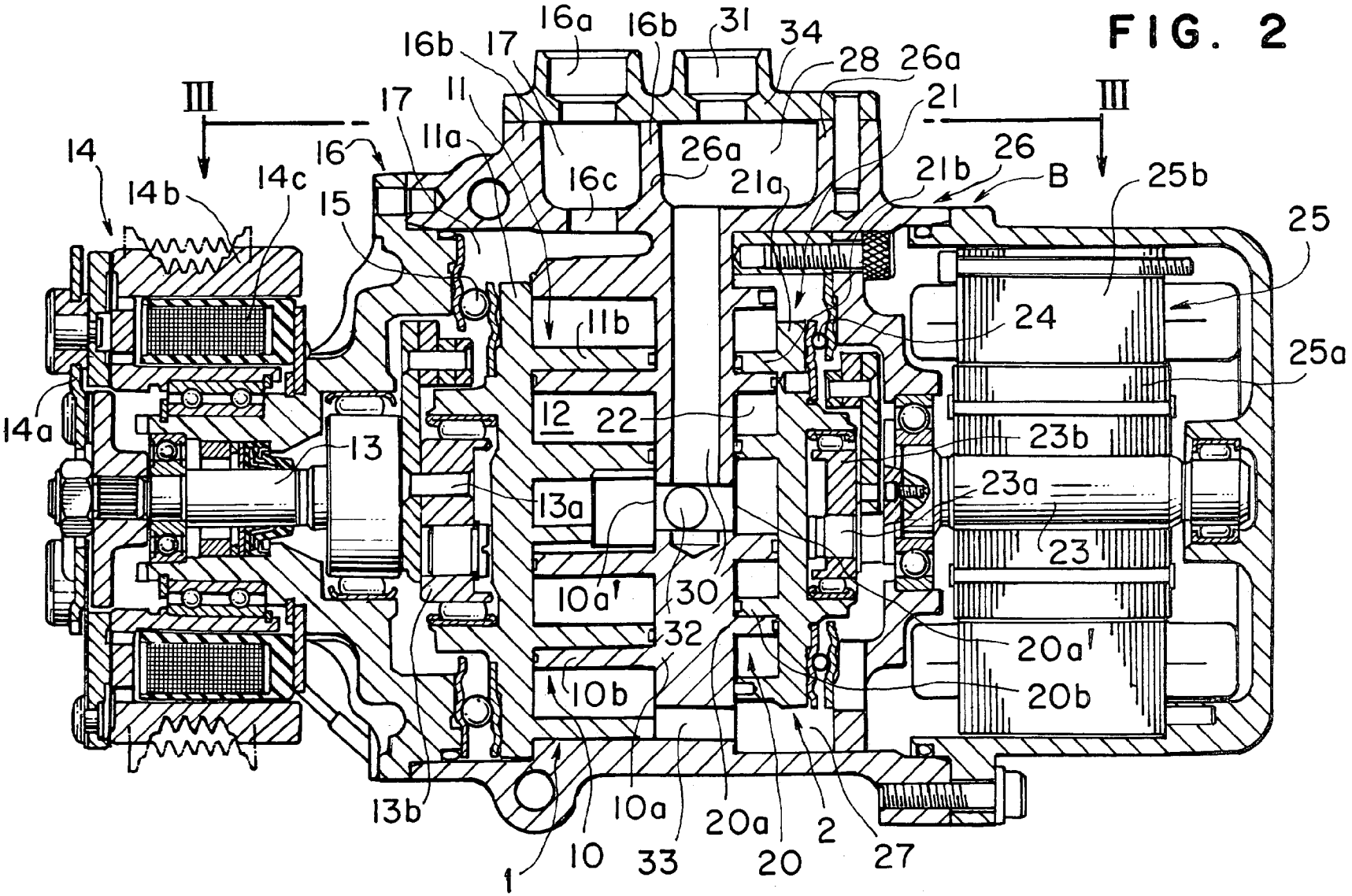
FIG. 2 is a longitudinal, cross-sectional view of a hybrid compressor according to another embodiment of the present invention.
Figure 3:
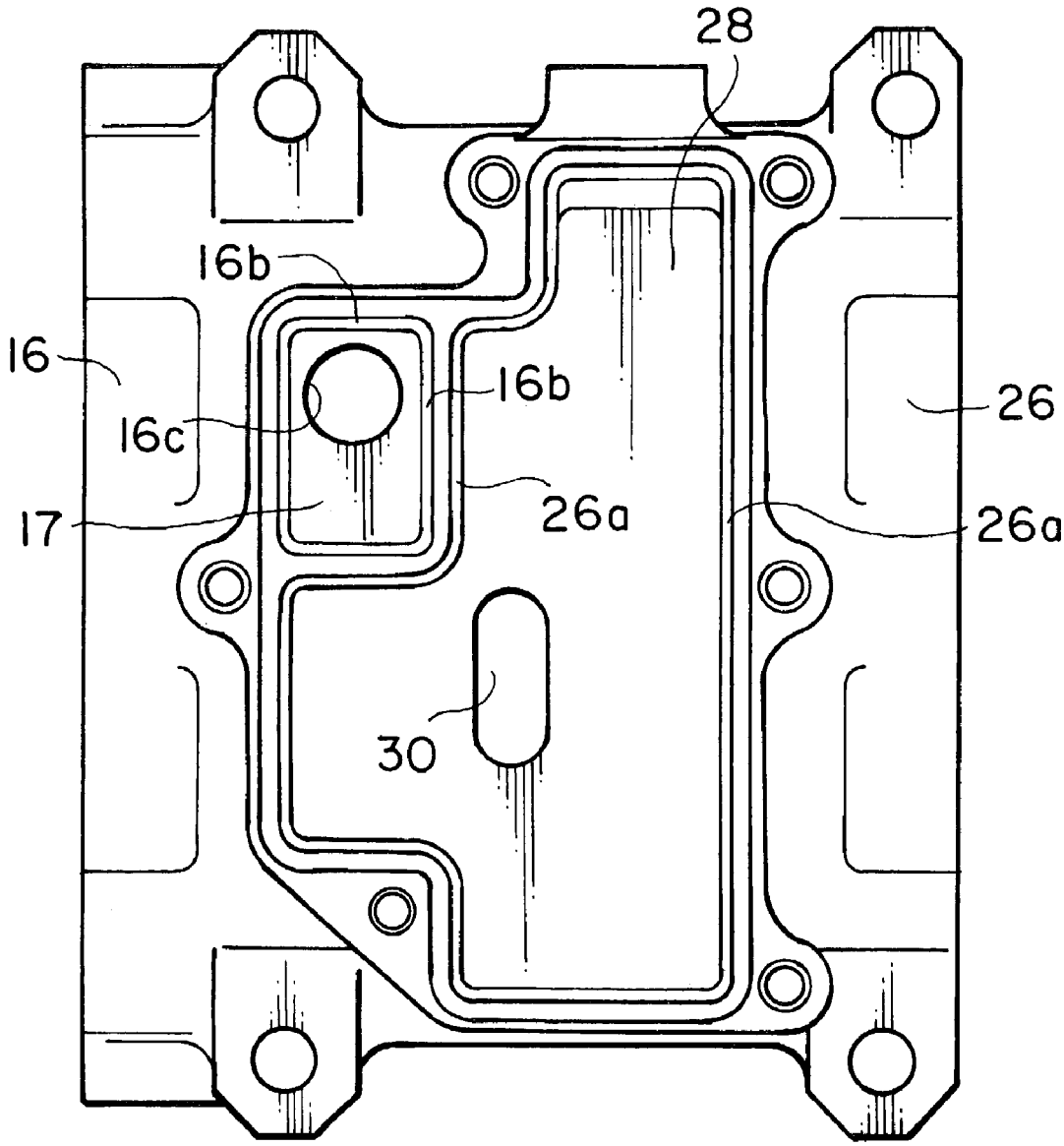
FIG. 3 is a cross-sectional view of the hybrid compressor depicted in FIG. 2, as viewed along line III-III of FIG. 2.

A hybrid compressor B according to another embodiment of the present invention is depicted in FIGS. 2 and 3. Referring to FIG. 2, hybrid compressor B has a structure similar to that of hybrid compressor A, as depicted in FIG. 1. Specifically, hybrid compressor B has substantially the same first compression mechanism 1, second compression mechanism 2, clutch 14, electric motor 25, rotation prevention mechanisms 15 and 24, and communication path 33, as those of hybrid compressor A depicted in FIG. 1.

In this embodiment, however, a suction chamber and a discharge chamber are formed radially outside of the housing. As depicted in FIGS. 2 and 3, an annular wall 16*b* projects from the exterior surface of first housing 16 of first compression mechanism 1, and annular wall 16*b* is formed integrally with first housing 16. The space enclosed by annular wall 16*b* is in communication with a first suction chamber 17, which is formed around the periphery of first fixed scroll 10 and first orbital scroll 11, through a communication path 16*c*, and the space enclosed by annular wall 16*b* forms a portion of first suction chamber 17. The space enclosed by annular wall 16*b* is contained with a lid 34, and an inlet port 16*a* is formed through lid 34.

An annular wall 26*a* projects from the exterior surface of second housing 26 of second compression mechanism 2, and annular wall 26*a* is formed integrally with second housing 26. A portion of annular wall 26*a* is integrated with a portion of annular wall 16*b*. The space enclosed by annular wall 26*a* forms a discharge chamber 28. Discharge chamber 28 communicates with the upper end of discharge path 30. Discharge chamber 28 is contained with lid 34, and outlet port 31 is formed through lid 34. The contact portions between lid 34 and annular walls 16*b* and 26*a* are sealed by annular seal members (not shown).

In hybrid compressor B, because discharge chamber 28 is formed outside of housing 26, increases in the length of housing 26 may be limited or eliminated while the capacity of the discharge chamber 28 may be made larger, as compared with a discharge chamber formed in the housing or in the integrated end plates 10*a* and 20*a*. By enlarging the capacity of discharge chamber 28, pulsations in discharge may be limited or eliminated. By forming discharge chamber 28 outside of housing 26, the disposition of the discharge chamber 28 may be varied and hybrid compressor B may increase. Further, in a hybrid compressor, because a plurality of drive sources generally are disposed in series in the axial direction, the axial length of the compressor tends to increase. However, by the disposition of discharge chamber 28 outside of housing 26, such an increase of the axial length of hybrid compressor B may be limited or eliminated, while the capacity of discharge chamber 28 may be increased.

Further, in a compressor having a piston-type compression mechanism, the capacity of a suction chamber preferably is increased in order to limit or eliminate pulsation in suction. Even in such a case, by forming suction chamber 17 outside of housing 16, the capacity of suction chamber 17 may be increased while any increase of the axial length of housing 16 is limited or eliminated. Therefore, pulsation in suction readily may be limited or eliminated. Moreover, by forming suction chamber 17 outside of housing 16, disposition of suction chamber 17 may be varied and variations in the design of hybrid compressor B may be increased.

The length of a housing of a scroll-type compressor generally is less than that of a piston-type compressor. By forming suction chamber 17 outside of housing 16, the length of the housing of hybrid compressor B having scroll-type compression mechanisms may be decreased further.

Discharge chamber 28 and suction chamber 17 outside of housings 16 and 26 may be formed readily by the use of lid 34 to cover chambers 28 and 17.

Figure 4:
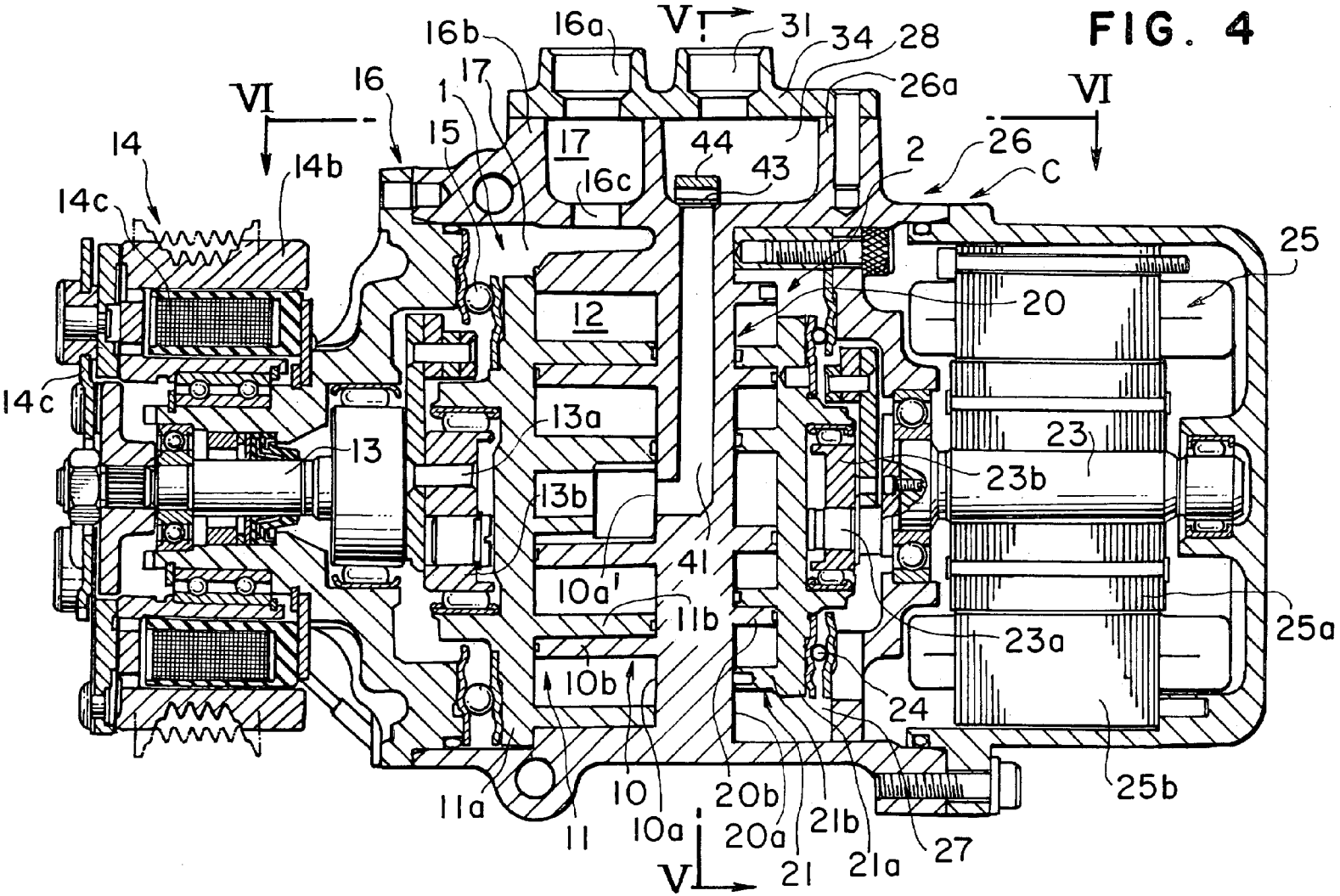
FIG. 4 is a longitudinal, cross-sectional view of a hybrid compressor according to still another embodiment of the present invention.
Figure 5:
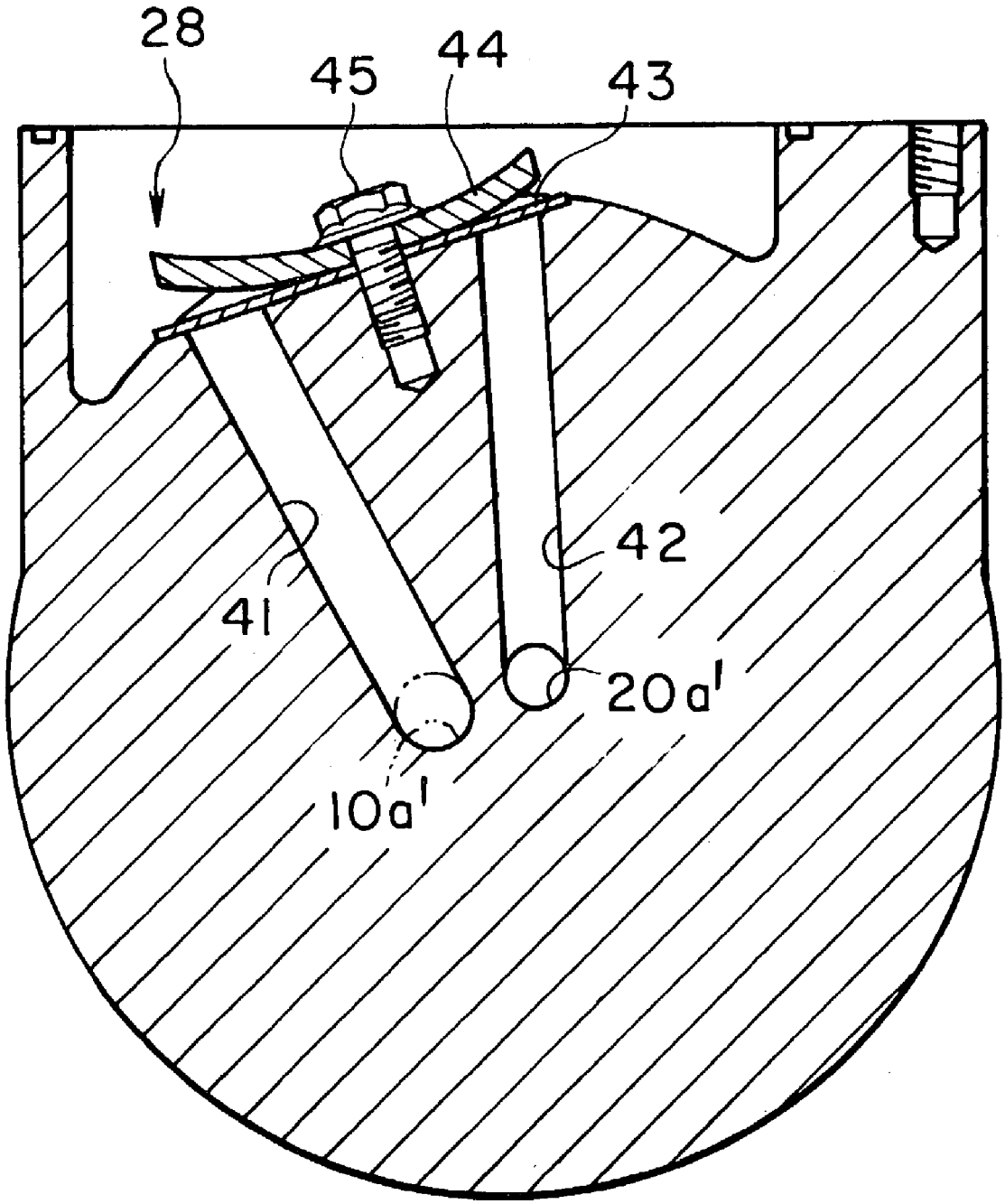
FIG. 5 is a cross-sectional view of the hybrid compressor depicted in FIG. 4, as viewed along line V-V of FIG. 4.
Figure 6:
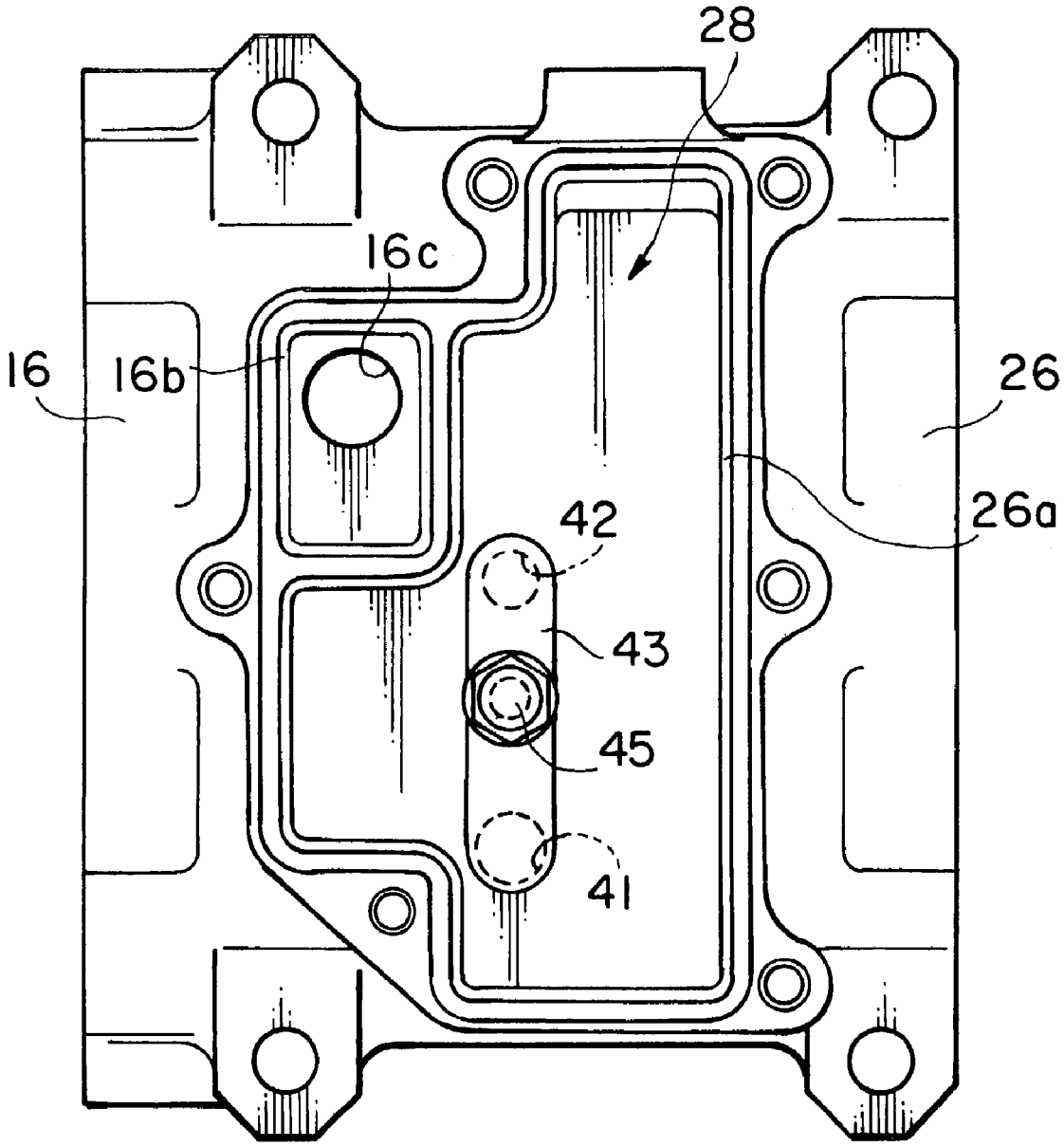
FIG. 6 is a cross-sectional view of the hybrid compressor depicted in FIG. 4, as viewed along line VI-VI of FIG. 4.

A hybrid compressor C according to still another embodiment of the present invention is depicted in FIGS. 4-6. Referring to FIG. 4, hybrid compressor C has a structure similar to that of hybrid compressor A, as depicted in FIG. 1. Specifically, hybrid compressor C has substantially the same first compression mechanism 1, second compression mechanism 2, clutch 14, electric motor 25, and rotation prevention mechanisms 15 and 24, as those of hybrid compressor A depicted in FIG. 1. Further, in this embodiment, a portion of suction chamber 17 and discharge chamber 28 are formed radially outside of housings 16 and 26, similarly to those in hybrid compressor B depicted in FIG. 2.

Figure 7:
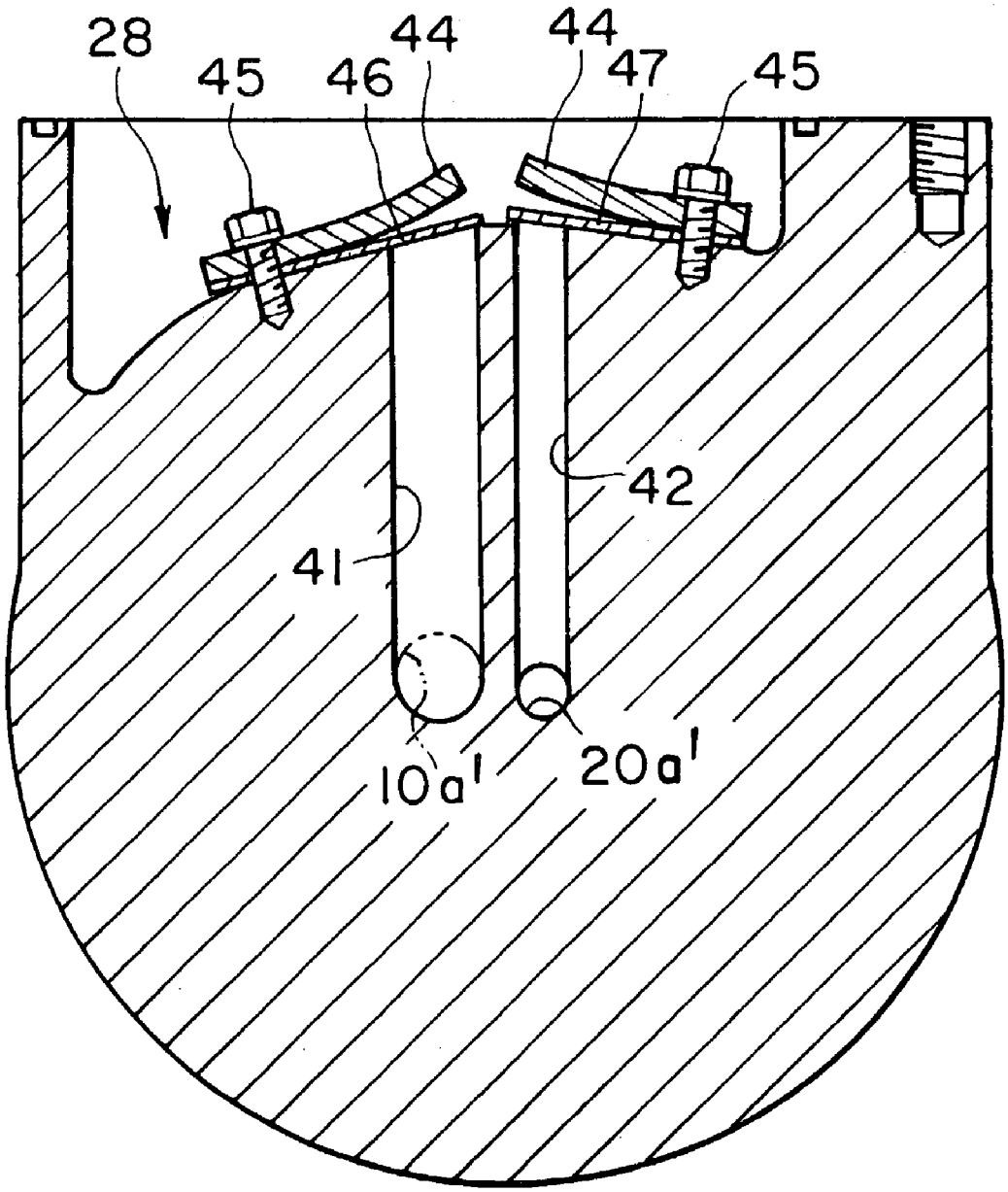
FIG. 7 is a cross-sectional view of a hybrid compressor according to a modification of the hybrid compressor depicted in FIG. 4.

In this embodiment, separate discharge paths are provided. Specifically, a first discharge path 41 is provided between first discharge port 10*a*' of first compression mechanism 1 and discharge chamber 28, and a second discharge path 42 is provided between second discharge port 20*a*' of second compression mechanism 2 and discharge chamber 28. First and second discharge paths 41 and 42 are separate from each other but communicate with common discharge chamber 28. A single, common discharge valve 43 is provided at the outlet portions of first and second discharge paths 41 and 42 for controlling opening and closing of discharge paths 41 and 42. The degree to which of discharge valve 43 is opened is regulated by retainer 44. Discharge valve 43 and retainer 44 are fixed together at their central portions on the outer surface of housing 26, by a bolt 45. Although single, common discharge valve 43 is provided in hybrid compressor C depicted in FIGS. 4-6, as depicted in FIG. 7, separated discharge valves 46 and 47 may be provided for respective discharge paths 41 and 42.

In this hybrid compressor C, because first discharge path 41 communicates with first compression mechanism 1, and second discharge path 42 communicates with second compression mechanism 2 and because these paths are formed independently from each other, the fluid compressed by first compression mechanism 1 flows into discharge chamber 28 through first discharge path 41 and the fluid compressed by second compression mechanism 2 flows into discharge chamber 28 through second discharge path 42, respectively. Specifically, the fluids compressed by respective compression mechanisms flow into discharge chamber 28 through respective exclusive discharge paths. Consequently, a problem of pulsation, which may occur when the compression mechanisms are switched and a single discharge path is provided for the two compression mechanisms, may be reduced or eliminated.

Further, in this embodiment, discharge paths 41 and 42 are both opened to a single discharge chamber 28, which is formed outside of housing 26. Therefore, because the compressed fluid is concentrated into discharge chamber 28, the capacity of discharge chamber 28 may be increased, thereby further reducing the above-described pulsation.

Moreover, because discharge paths 41 and 42 are both opened to a single discharge chamber 28, as shown in FIGS. 5 and 6, both discharge paths 41 and 42 may be controlled to be opened and closed by only a single discharge valve 44. Therefore, cost savings may be achieved due to the reduction of the number of parts. Further, because discharge valve 44 is provided in discharge chamber 28, which is formed radially outside of housing 26, the ease of installing the valve may be greatly improved, as compared with the configuration in which a discharge valve is provided between the compression mechanisms and a common discharge path formed between the compression mechanisms.

Although preferred embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A hybrid compressor comprising:

a first compression mechanism, which is driven by a first drive source;

a second compression mechanism, which is driven by a second drive source, and which is incorporated into said compressor integrally with said first compression mechanism; and means for communicating in both directions between a first suction chamber of said first compression mechanism and a second suction chamber of said second compression mechanism.

2. The hybrid compressor according to claim 1, wherein said hybrid compressor has a single inlet port supplying refrigerant to said suction chambers.

3. The hybrid compressor according to claim 1, wherein when only one of said first and second compression mechanisms is in operation, said means for communicating places a first lower portion of said suction chamber of said operating compression mechanism in communication with a second lower portion of said suction chamber of said other compression mechanism.

4. The hybrid compressor according to claim 1, wherein said first and second compression mechanisms are scroll-type compression mechanisms.

5. The hybrid compressor according to claim 1, wherein said first drive source is selected from the group consisting of an internal combustion engine and a first electric motor for running a vehicle, and said second drive source comprises a second electric motor.

6. The hybrid compressor of claim 1, further comprising means for preventing each of a first fluid discharged from the first compression mechanism from entering the second compression mechanism, and a second fluid discharged from the second compression mechanism from entering the first compression mechanism.

7. The hybrid compressor of claim 6, wherein the means for preventing comprises at least one valve positioned between the first discharge port and the second discharge port.

8. The hybrid compressor of claim 7, wherein the at least one valve comprises a check valve.

9. The hybrid compressor of claim 8, wherein the first compression mechanism and the second compression mechanism are driven selectively, and wherein when the first drive source drives the first compression mechanism the check valve closes the second discharge port, and when the second drive source drives the second compression mechanism the check valve closes the first discharge port.

10. The hybrid compressor of claim 8, wherein the first compression mechanism and the second compression mechanism are driven simultaneously.

11. A hybrid compressor comprising:

a first compression mechanism, which is driven by a first drive source;

a second compression mechanism, which is driven by a second drive source, and which is incorporated into said compressor integrally with said first compression mechanism;

a suction chamber common to both said first and second compression mechanisms; and a common inlet port supplying refrigerant to said common suction chamber, wherein said common suction chamber comprises:

a first chamber portion associated with said first compression mechanism, a second chamber portion associated with said second compression mechanism, and a communication path providing fluid con-imunication between said first chamber portion and said second chamber portion, and wherein said common suction chamber is configured to selectively supply refrigerant from said common inlet port to said second chamber portion via said first chamber portion and said communication path when said first compression mechanism is idle.

12. The hybrid compressor according to claim 11, wherein said first and second compression mechanisms arc scroll-type compression mechanisms.

13. The hybrid compressor according to claim 11, wherein said first drive source is selected from the group consisting of an internal combustion engine and a first electric motor for running a vehicle, and said second drive source comprises a second electric motor.

14. The hybrid compressor of claim 11, further comprising means for preventing each of a first fluid discharged from the first compression mechanism from entering the second compression mechanism, and a second fluid discharged from the second compression mechanism from entering the first compression mechanism.

15. The hybrid compressor of claim 14, wherein the means for preventing comprises at least one valve positioned between the first discharge port and the second discharge port.

16. The hybrid compressor of claim 15, wherein the at least one valve comprises a check valve.

17. The hybrid compressor of claim 16, wherein the first compression mechanism and the second compression mechanism are driven selectively, and wherein when the first drive source drives the first compression mechanism the check valve closes the second discharge port, and when the second drive source drives the second compression mechanism the check valve closes the first discharge port.

18. The hybrid compressor of claim 16, wherein the first compression mechanism and the second compression mechanism are driven simultaneously.

* * * * *